US010136718B2

(12) United States Patent
Zembrod

(10) Patent No.: US 10,136,718 B2
(45) Date of Patent: Nov. 27, 2018

(54) VALVE MECHANISM WITH APPLICATOR TIP FOR COSMETIC CONTAINERS

(71) Applicant: Eric Zembrod, Boituva (BR)

(72) Inventor: Eric Zembrod, Boituva (BR)

( * ) Notice: Subject to any disclaimer, the term of this patent is extended or adjusted under 35 U.S.C. 154(b) by 89 days.

(21) Appl. No.: 15/323,910

(22) PCT Filed: Jun. 25, 2015

(86) PCT No.: PCT/BR2015/050079
§ 371 (c)(1),
(2) Date: Jan. 4, 2017

(87) PCT Pub. No.: WO2016/000054
PCT Pub. Date: Jan. 7, 2016

(65) Prior Publication Data

US 2017/0143096 A1 May 25, 2017

(30) Foreign Application Priority Data

Jul. 4, 2014 (BR) ..... 1020140166890

(51) Int. Cl.
*A47L 13/30* (2006.01)
*A45D 33/02* (2006.01)
(Continued)

(52) U.S. Cl.
CPC ..... *A45D 33/02* (2013.01); *A45D 33/005* (2013.01); *A45D 34/04* (2013.01); *A45D 34/042* (2013.01);
(Continued)

(58) Field of Classification Search
CPC ..... A45D 34/04; A45D 34/041; A45D 45/26; A45D 45/261; A45D 40/26; A45D 40/261
(Continued)

(56) References Cited

U.S. PATENT DOCUMENTS 4,368,746 A 1/1983 Spatz
4,987,911 A 1/1991 Powers
(Continued)

FOREIGN PATENT DOCUMENTS

BR PI0409547 4/2006
CN 103826753 5/2014

OTHER PUBLICATIONS

International Search Report dated Sep. 24, 2015 in International Application No. PCT/BR2015/050079.

*Primary Examiner* — Jennifer C Chiang
(74) *Attorney, Agent, or Firm* — B. Aaron Schulman, Esq.; Stites & Harbison, PLLC

(57) ABSTRACT

An assembly having a valve mechanism with applicator tip for cosmetic containers, in particular for compressible tubes, having two separate valves, one in the actuation mechanism and one at the applicator tip, with a lid-like mounting base having an external attaching element for attachment of the base in a liquid-tight manner to the bottleneck of a suitable compressible container, and having an internal attaching element which also defines a passage for a product. The internal attaching element is also an integral part of a first valve capable of sliding upwards and downwards, with the lower end of the first valve oriented to open and close the passage, while the upper end is centered inside a sleeve, wherein the sleeve receives through its top end the base of an applicator tip into its inner portion, and the external portion of the sleeve receives an overcap that surrounds the applicator tip.

9 Claims, 19 Drawing Sheets

(51) Int. Cl.
*A45D 40/26* (2006.01)
*A45D 34/04* (2006.01)
*A45D 33/00* (2006.01)

(52) U.S. Cl.
CPC ..... *A45D 40/26* (2013.01); *A45D 40/261* (2013.01); *A45D 2200/051* (2013.01); *A45D 2200/054* (2013.01)

(58) Field of Classification Search
USPC ..... 401/261, 265, 266
See application file for complete search history.

(56) References Cited

U.S. PATENT DOCUMENTS 5,960,802 A 10/1999 Sakai
6,745,781 B2 6/2004 Gueret
6,793,431 B1 9/2004 Tsai
7,255,510 B2 8/2007 Bougamont
7,309,184 B2 12/2007 Butcher et al.
7,384,208 B2 6/2008 Bouix et al.
7,488,133 B2 2/2009 Kuo
7,722,277 B2 5/2010 Byun
7,824,124 B2 11/2010 Francavilla et al.
8,226,319 B2 7/2012 Francavilla et al.
8,297,869 B2 10/2012 Oreal
8,662,776 B2 3/2014 Porter et al.
8,714,857 B1 5/2014 Liu
9,226,562 B2 1/2016 Sauvage et al.
2002/0014254 A1 2/2002 Gueret
2002/0090247 A1 7/2002 Breidenbach et al.
2003/0057236 A1 3/2003 Delage
2006/0071034 A1 4/2006 Bougamont
2013/0108349 A1 5/2013 Thorpe
2014/0097208 A1 4/2014 Sauvage et al.
2016/0029772 A1* 2/2016 Defert ..... A45D 34/04 401/265
2016/0324295 A1* 11/2016 Lee ..... A45D 34/041
2018/0116369 A1* 5/2018 Byun ..... A45D 34/04

* cited by examiner

VALVE MECHANISM WITH APPLICATOR TIP FOR COSMETIC CONTAINERS

FIELD OF THE INVENTION

The present invention relates generally to the field of topical product applicators and containers, and in particular to an apparatus comprising an internal valve system that may be used for controlling product flow between a container and an applicator nozzle.

BACKGROUND OF THE INVENTION

A wide variety of topical product containers with applicator nozzles are well known in the prior art. Examples are found in the following documents: CN103826753A, U.S. Pat. No. 4,987,911, U.S. Pat. No. 5,960,802, U.S. Pat. No. 6,745,781, U.S. Pat. No. 6,793,431, U.S. Pat. No. 7,309,184, U.S. Pat. No. 7,824,124, U.S. Pat. No. 8,226,319, U.S. Pat. No. 8,662,776, U.S. Pat. No. 8,714,857, US2013/108349, US2002/0014254, US2002/0090247, US2003/0057236 and US20030057236. Each document describes a specific type of construction for the application of a product, always in order to offer a more efficient way of handling, controlling and applying the product.

The mechanisms currently known for the purpose described above are sufficient for a product to be applied correctly; however, mechanisms that work with internal valves, although efficient, could use considerable improvement, as many of them use springs, spheres and other widely varying types of mobile mechanical components. The result is a final mechanism that is substantially complicated, and the delivery of product at the end of the tip often does not occur as desired. Consequently, these assemblies are difficult to manufacture, both in terms of fabrication of the components as well as their final assembly, which significantly increases the costs thereof. Additionally, the aforementioned issues occur without even obtaining the result of stringent control of the amount of product dispensed, and, in some cases, with the residual pressure of the container causing minor drips or leaks and thus wasted product.

SUMMARY OF THE INVENTION

The present invention seeks to provide a product applicator intermediate assembly between a container and an applicator nozzle, comprising an actuation mechanism and having multiple valves and at least two possible types of applicator nozzles for use on different types of substantially flexible containers. The container contents are extracted in largely the same manner as cosmetics of different stages of fluidity, which are normally packed in compressible tubes and/or all types of filled recipients that may facilitate and allow stringent control of the quantity of product to be applied, as occurs with topical products such as, for example, either cosmetics or drugs.

On its lower side, the assembly presents means for being connected to a suitable container such as, for example, a compressible tube, for example, containing a fluid that flows easily, whether a liquid, oil, cream, paste or powder, such as a cosmetic or a drug, while on its upper side the assembly can be fitted with different applicator tips, most notably those whose ergonomics are intended for application around the eyes or lips. The actuation mechanism is endowed with means to combine with the applicator tip, and by performing a 90° turn, an internal valve system either closes or opens, allowing product to flow with excellent quality control to the applicator tip that in turn also includes another product outflow control valve, whereby a desired quantity of product may be delivered to the surface of the applicator tip. The applicator tip in turn has variable geometry, adapting to the anatomy of the place where the product is being applied, such as for example on the eyes or lips.

The present invention seeks to provide two separate valves, one in the actuation mechanism and one at the applicator tip. The first valve is a mobile component, combining a fixed stopper and a small tubular hollow plunger that is in turn comprising the first passage for the product, with the plunger also being mobile in order to move axially towards or away from the stopper, resulting in the leakproof closing or opening of its central passage. This movement results from the fact that the plunger has two radially opposed follower studs supported on keyways with cams, that are engaged through these follower studs with the lower cylindrical rotating part of the applicator tip, whereby 90° turns in a clockwise or counter-clockwise direction establish an upward and downward movement of the hollow plunger, allowing or halting the flow of the product into the applicator tip.

The applicator tip is anatomically shaped in conformity with the fingertip of a forefinger, the entire contact area being formed from an elastomer layer on which a small internal pouch is created, that in turn serves as a "balloon" that accumulates a predetermined amount of product and remains static so long as the container is not pressed. Upon pressing of the container, the pressure in the pouch increases sufficiently for a strategic valve opening in the digital part of the applicator tip to open and allow the controlled outflow of a desired quantity of the product. The valve is in the form of a small slot, the opening of which allows product to be delivered exactly on the surface of the applicator tip. At this stage, the applicator tip is ready to be rubbed lightly over the part of the body, such as the eyes or the lips, where the product is applied efficiently with no waste.

The applicator tip, having an elastomer layer that forms a second valve-controlled outlet, may have an assortment of shapes depending on the fabrication process, such as for example fabrication by injection, heat molding or vulcanization, with the tip always shaped in order to facilitate the application of creams, gels, powders and any other solids or semi-solids, ensuring that they are applied correctly. The elastomer layer may be shaped in compliance with the specific needs of the area to be treated, allowing for maximum application control and no waste, with the desired volume of product, as defined by the user, dispensed when pressing the container.

The applicator tip is valve-controlled because its elastomer layer presents at least one outlet defined by a slot, whose dimensions may be adjusted according to each product and its density, viscosity, surface tension and additives altering the formulation characteristics and consequently the product flow, compliant with the specific needs of each of these formulation characteristics and requirements. This applicator may be made from elastomeric memory material, giving it the ability to return to the shape in which it was molded, whereby when the product runs through the slot, the memory effect of the material results in the passage being closed automatically once the internal container pressure ceases. This process is normally called self-closing, with this effect in specific applicators designed for each use in each region of the skin or body, allowing for far safer applications, as it does not allow contaminants to enter the external area or the external or internal parts of the container, thus avoiding contamination of the contents of the container. This benefit is highly sought after by the pharmaceutical, cosmetic, veterinary and even industrial markets, and also functions to avoid inflows of oxygen that could oxidize the product or result in other undesirable alterations to its formulation.

DETAILED DESCRIPTION OF THE INVENTION

Figure 1:
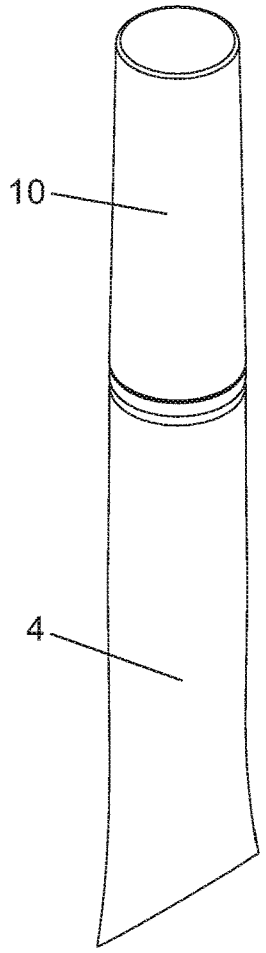
FIG. 1 shows a top perspective view of the mounted assembly.
Figure 2:
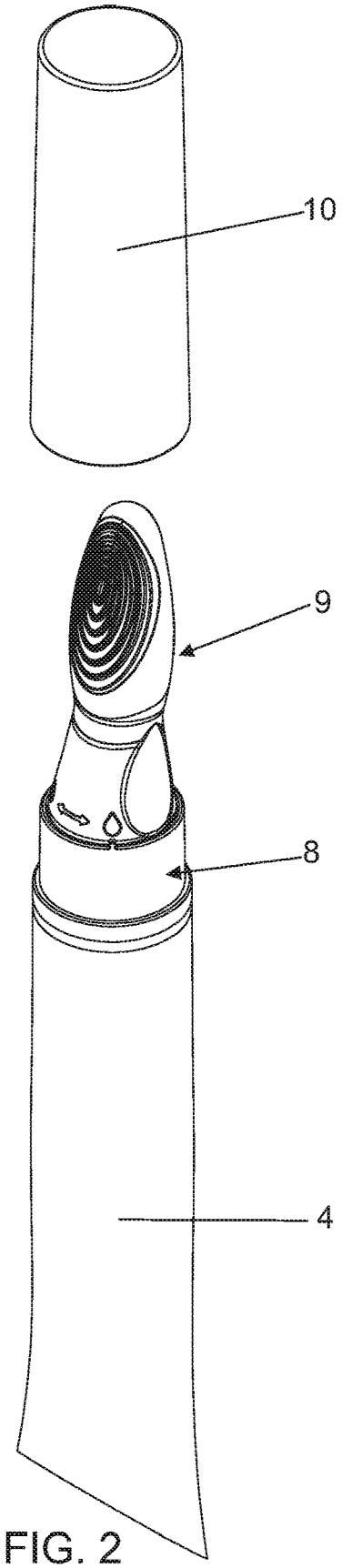
FIG. 2 shows a perspective view of the assembly with the overcap exploded, displaying the applicator tip.
Figure 3:
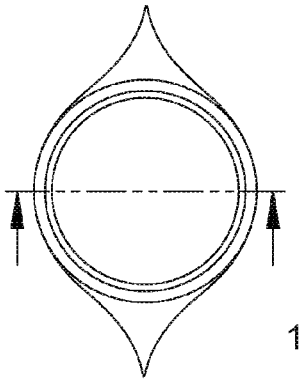
FIG. 3 shows a top perspective view of an indication of a slot in an applicator tip.
Figure 4:
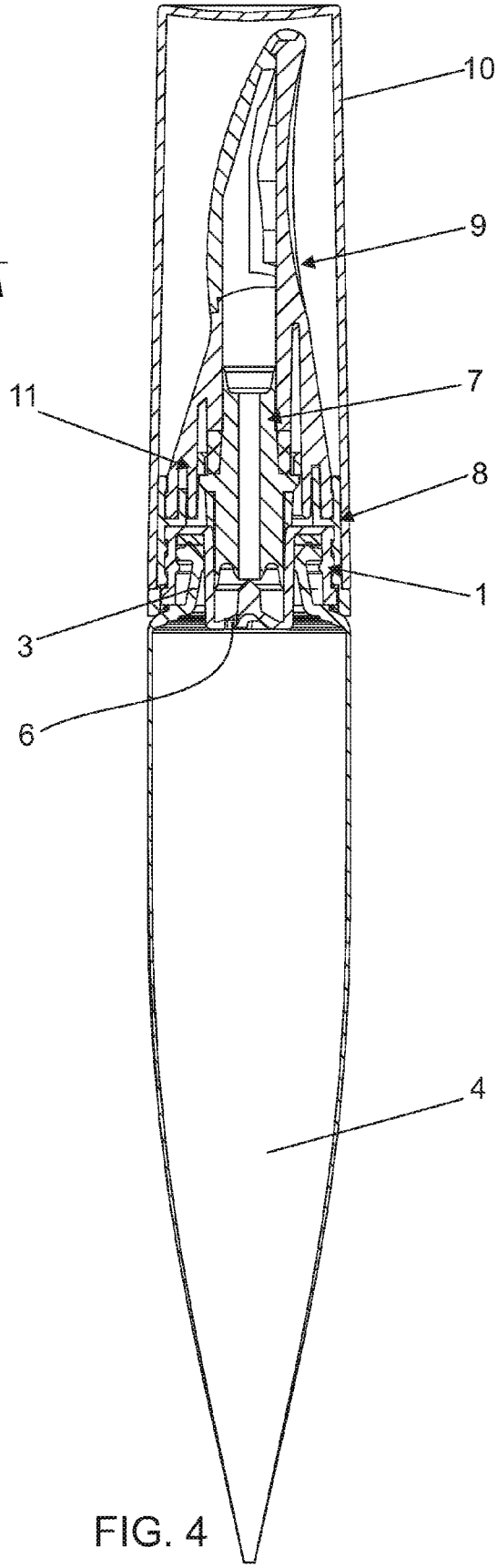
FIG. 4 shows a perspective view of the mounted assembly.
Figure 5:
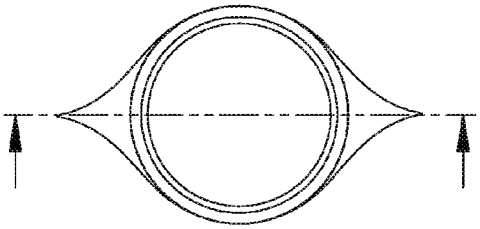
FIG. 5 shows a top perspective view with an indication of another slot.
Figure 6:
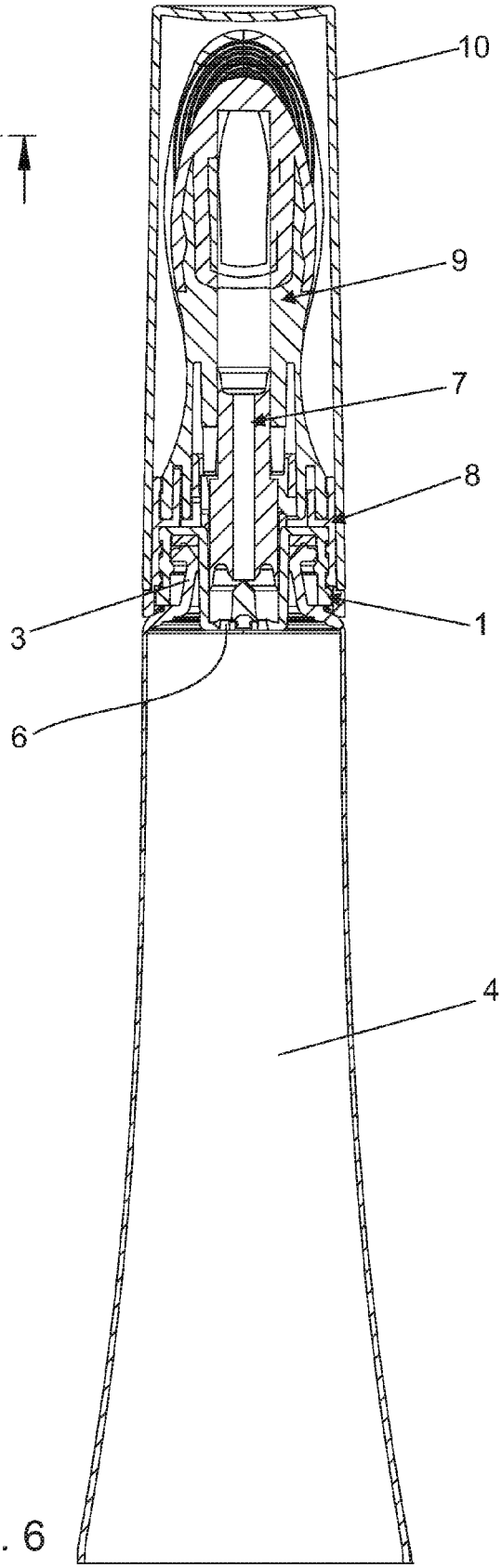
FIG. 6 shows another perspective view of the indicated slot, showing the mounted assembly.
Figure 7:
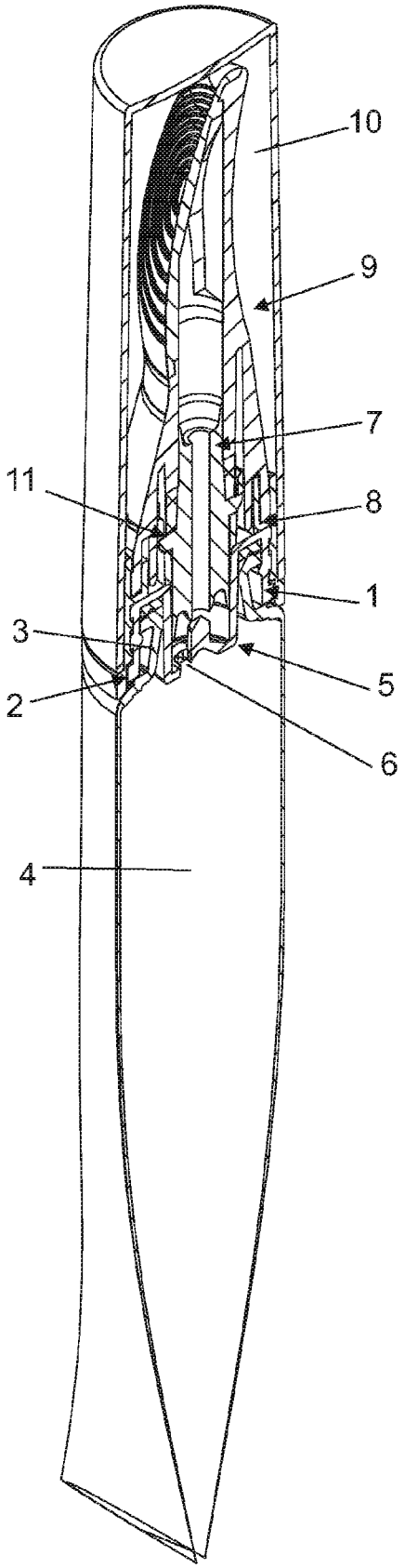
FIG. 7 shows an isometric cross-section of the mounted assembly.
Figure 8:
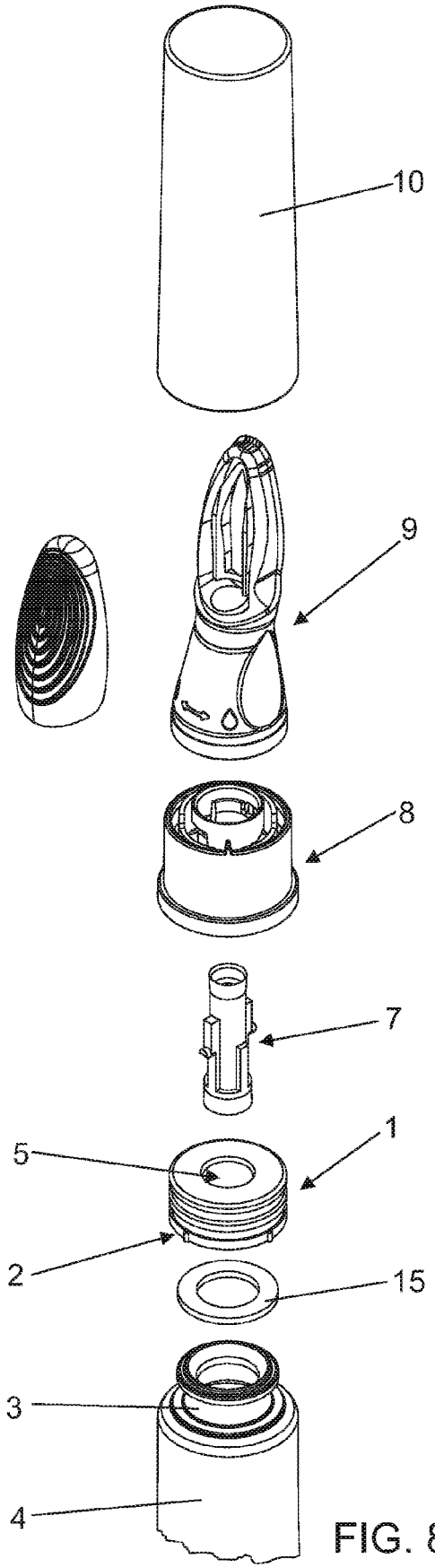
FIG. 8 shows an exploded perspective view of the assembly as seen from above.
Figure 9:
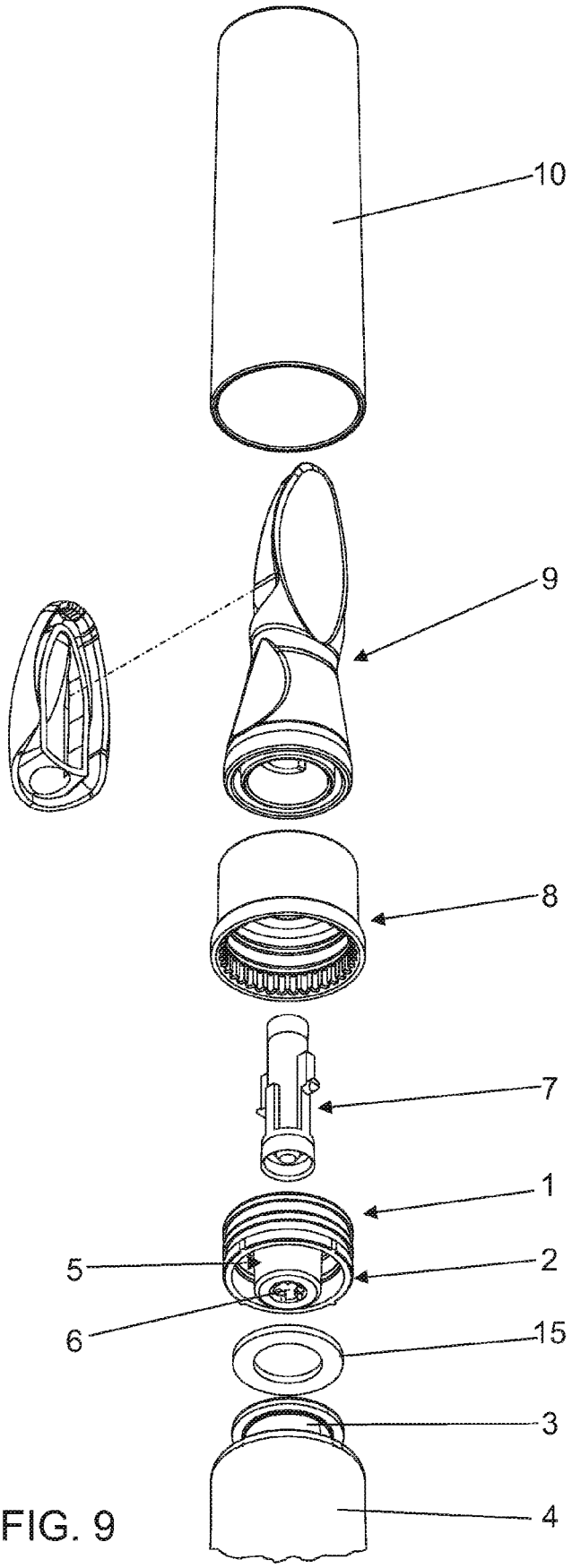
FIG. 9 shows an exploded perspective of the assembly as seen from below.

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the invention.

As illustrated in FIGS. 1 to 9 the present invention is an assembly having a valve mechanism with an applicator tip for cosmetic containers. The assembly comprising: a lid-like circular mounting base (1) with an external attaching element (2) for leak proof attachment to the bottleneck (3) of a suitable container (4); an internal attaching element (5) defining a passage (6) for the product and also constituting an integral part of a first valve (7) which slides upwards and downwards, and having a lower end oriented to open and close the passage (6); a sleeve (8) which centrally houses the end of the first valve, and also internally receives the base of an applicator tip (9) from above, while the outer part of the sleeve receives the overcap (10) surrounding the applicator tip (9); wherein the circular mounting base (1) is coupled to rotate inside the sleeve (8), and combined with an actuation mechanism (11) that is formed between the mounting base and the sleeve, the actuation mechanism constituting the means for moving the first valve upwards or downwards (7) in order to open and close the product passage (6).

The applicator tip (9) is axially attached inside the sleeve (8) and to the corresponding part of the valve (7), whereby it may be twisted in both directions, with the actuation mechanism (11) moving the valve upwards and downwards (7) in order to open or close the product passage (6).

Figure 10:
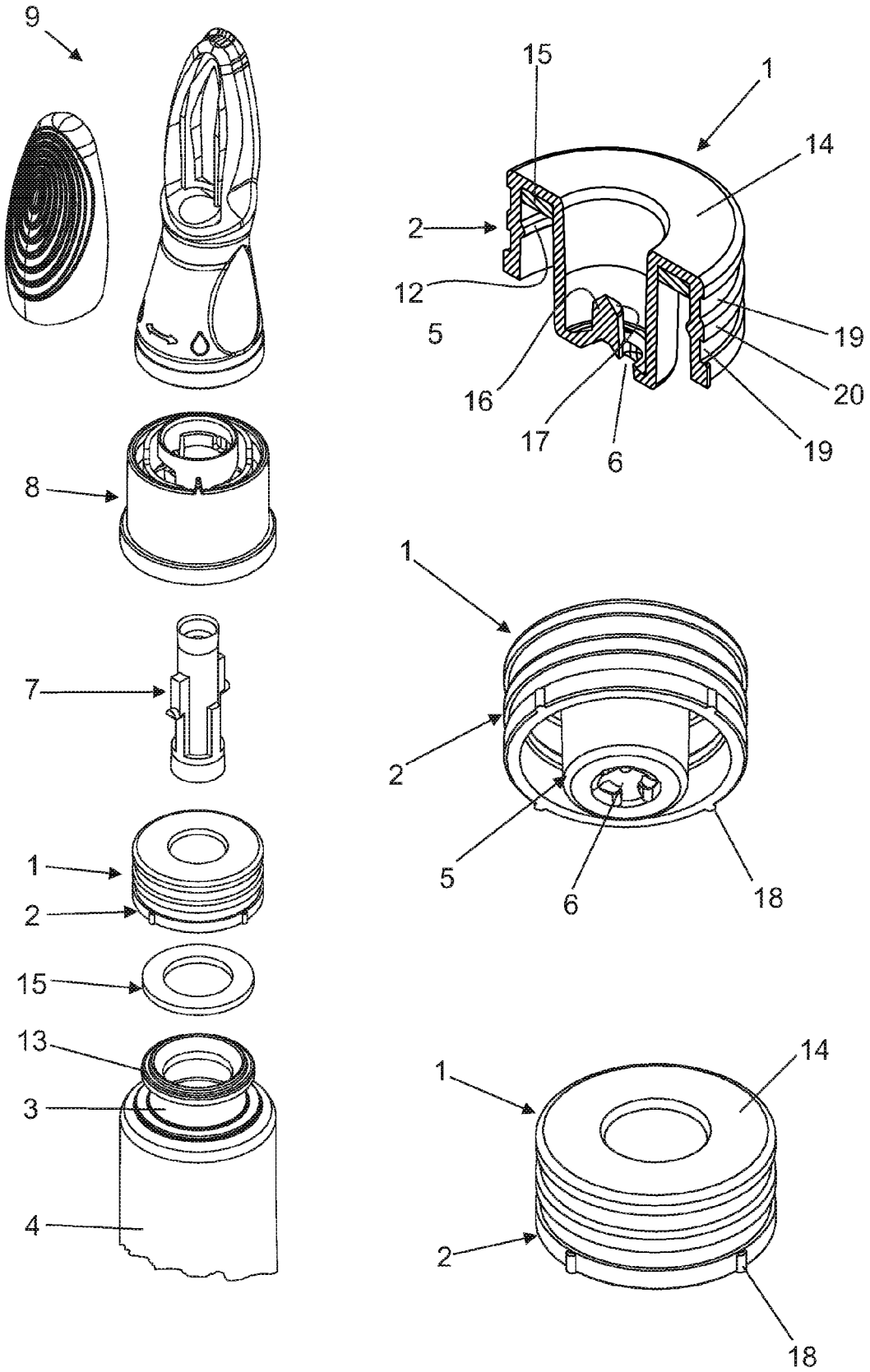
FIG. 10 shows several perspective views of the mounting base.

The details of the mounting base (1) are shown in FIG. 10, illustrating that the external attaching element (2) and the internal attaching element (5) are formed by two cylindrical concentric sectors, in which the first sector constitutes a circular skirt with an internal lock (12) forming a leakproof attachment to the corresponding lip (13) of the bottleneck (3) of a suitable container (4). On the upper side of the mounting base is a blind flange (14) projecting perpendicularly inwards, the flange being integrated with the internal attaching element (5) in the shape of a cup, and wherein the diameter of the internal attaching element fits tightly into the bottleneck (3) like a stopper, being fitted with a sealing washer (15) and with the bottom of the internal attaching element being pierced to allow for throughflow within the product passage (6). In the center of the product passage there is an internal raised cylindrical stopper (16) with a tapered tip (17). The external diameter of the external attaching element (2) is also endowed with details allowing for attachment to the bottom end of the sleeve (8), in the form of anti-rotational locking lugs (18) and annular channels (19) that form an intermediate axial locking step (20).

Figure 11:
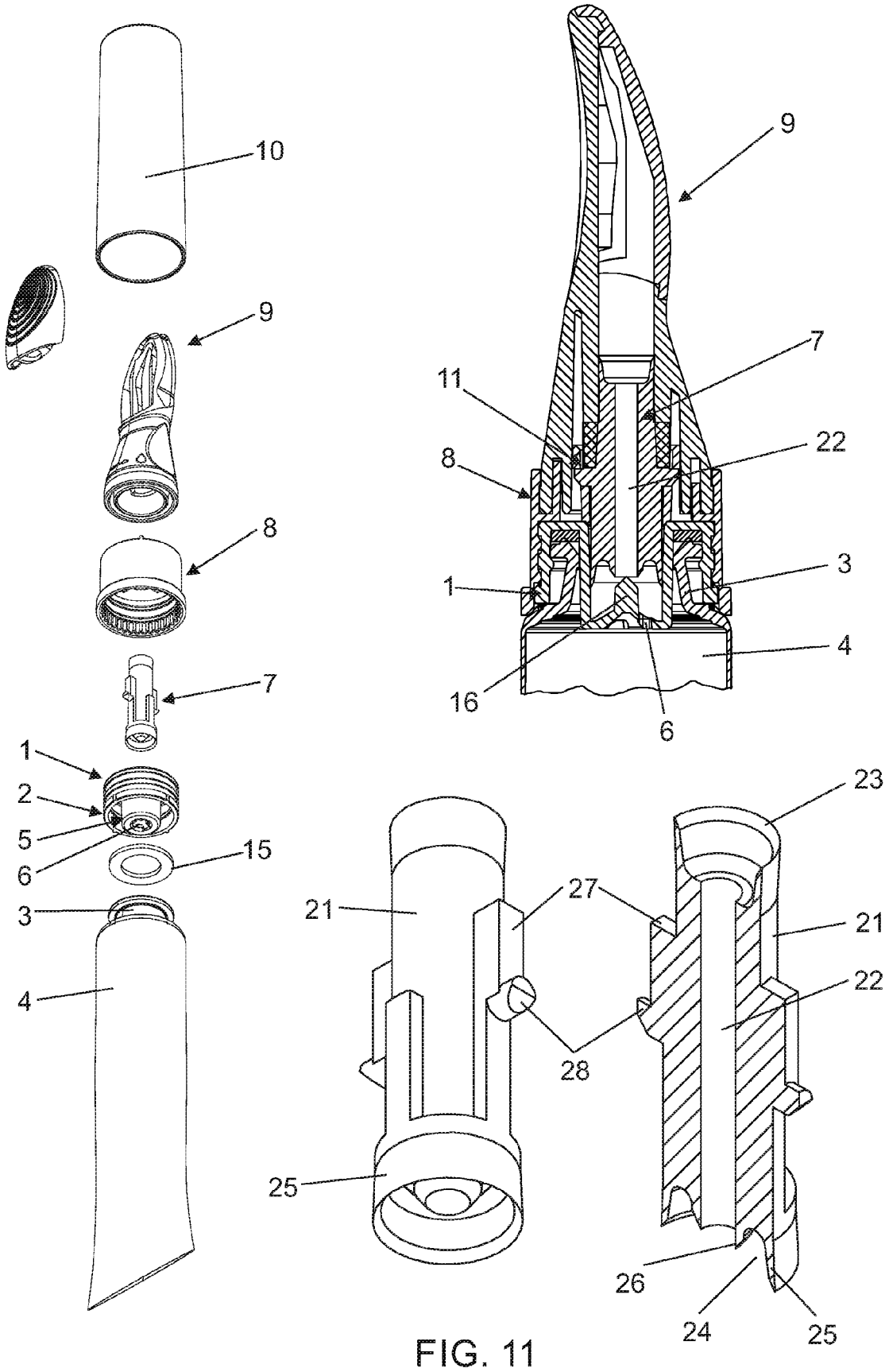
FIG. 11 shows several views both in perspective and cross-section, illustrating details of the valve formed by the plunger.

Details of the valve (7) are shown in FIG. 11, illustrating that it consists of a vertical plunger (21) pierced lengthwise by a feeder tube (22) and having an upper end which widens internally to form an upper sealing lip (23), the lower end of the feeder tube also widening internally and forming a circular channel (24) which forms two concentric sealing lips, an outer sealing lip (25), and an inner sealing lip (26). The outer sealing lip (25) slides over the internal attaching element (5) of the mounting base (1), while the inner sealing lip (26) surrounds the end of the feeder tube (22), forming a tip covering the cylindrical stopper (16) that opens and closes the feeder tube (22). The external diameter of the vertical plunger (21) fitted with longitudinal guide lugs (27) and two radially opposed follower studs (28) that couple onto the actuation mechanism (11).

Figure 12:
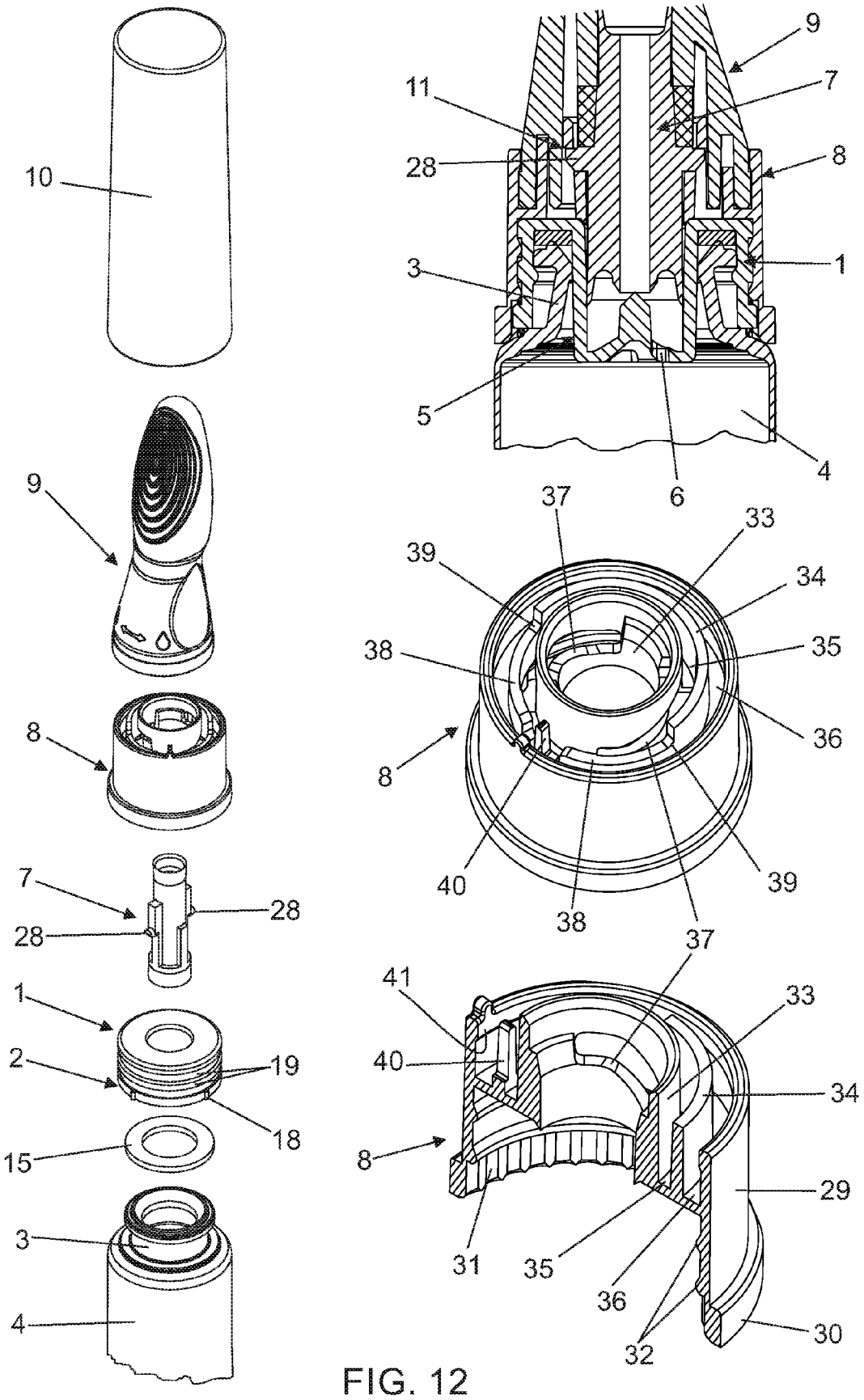
FIG. 12 shows several views both in perspective and cross-section, illustrating details of the sleeve surrounding the plunger-type valve.

Details of the sleeve (8) are shown in FIG. 12, illustrating that the sleeve initially comprises a cylindrical skirt (29), with a wider bottom edge forming an external flap (30) that constitutes a slot for the bottom end of the overcap (10), the inside of the flap having a plurality of grooves (31) above which are two protuberant annular sectors (32). Both annular sectors are attached to the mounting base (1), where the grooves (31) engage with the anti-rotational locking lugs (18) and the two protuberant annular sectors (32) engage with the annular channels (19), comprising a coupling and permanent attachment between the mounting base and sleeve components, thus preventing the entire assembly coming loose and preventing any movement among the mounting base (1), container (4) and sleeve (8) components.

The upper part of the sleeve (8) is defined by two additional internal, circular and concentric walls, an inner wall (33) and an outer wall (34), with two channels, an inner channel (35) and outer channel (36) formed between them, within which is attached in a revolving manner, the lower end of the applicator tip (9). The smaller diameter inner wall (33) also comprises a slider housing for the upper end of the vertical plunger (21), the end having the upper sealing lip (23). To achieve this, the inner wall (33) also includes two diametrically opposed keyways that constitute the surfaces of the cams (37), pierced by the radially opposed follower studs (28) that are exposed in the inner channel (35) and are in a position to couple with the lower end of the applicator tip (9). Thus, the applicator tip is able to move the follower studs over the surfaces of the cams (37), and thus move the valve upwards or downwards (7), opening or closing it with 90° twists in both directions. To do so, the upper edge of the inner wall (33) of the sleeve (8) is lowered over a length of rabbet (38) ending in rabbet buffers and a light lock (39) that defines the open and closed positions, with this rabbet (38) also having a midline projection in the form of vertical pin (40) that constitutes a buffer and limit on the 90° movement, whether open or closed, for the overcap (10). There is also a lock formed by a protruding inner edge (41) on the cylindrical skirt (29) of the sleeve (8).

Figure 13:
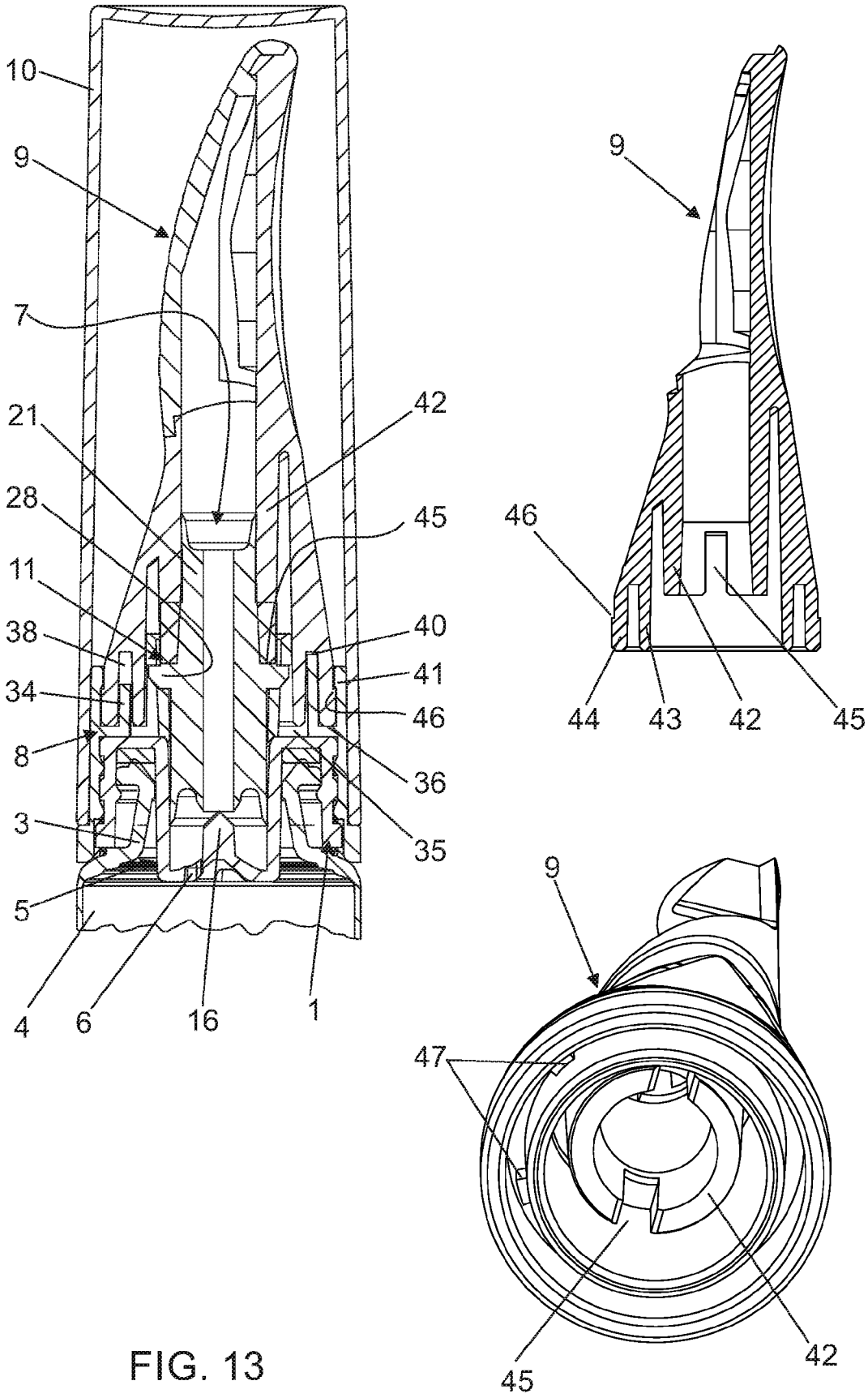
FIGS. 13 to 18 show several views both in perspective and cross-section, illustrating the construction details of the applicator tip.
Figure 14:
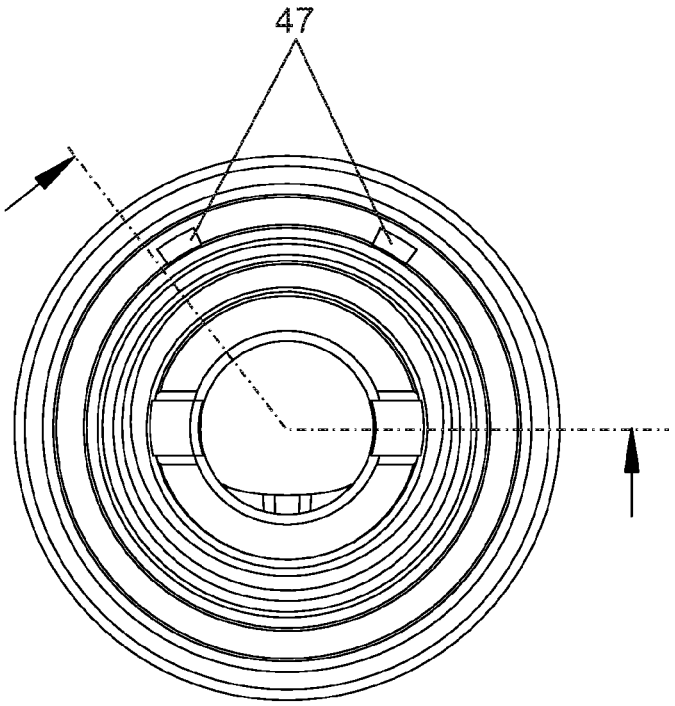
Figure 14:
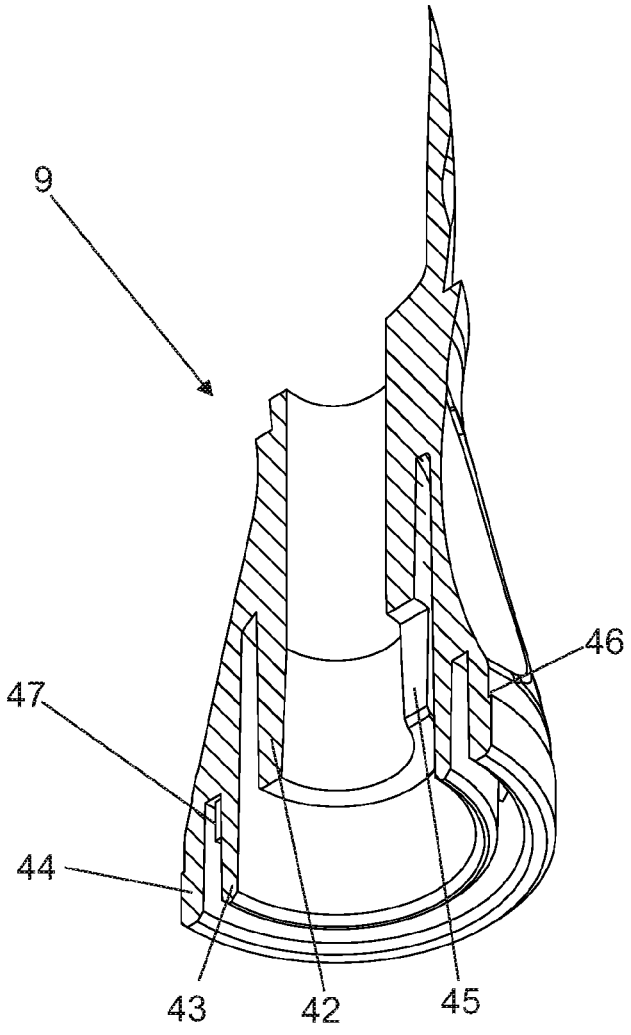
Figure 15:
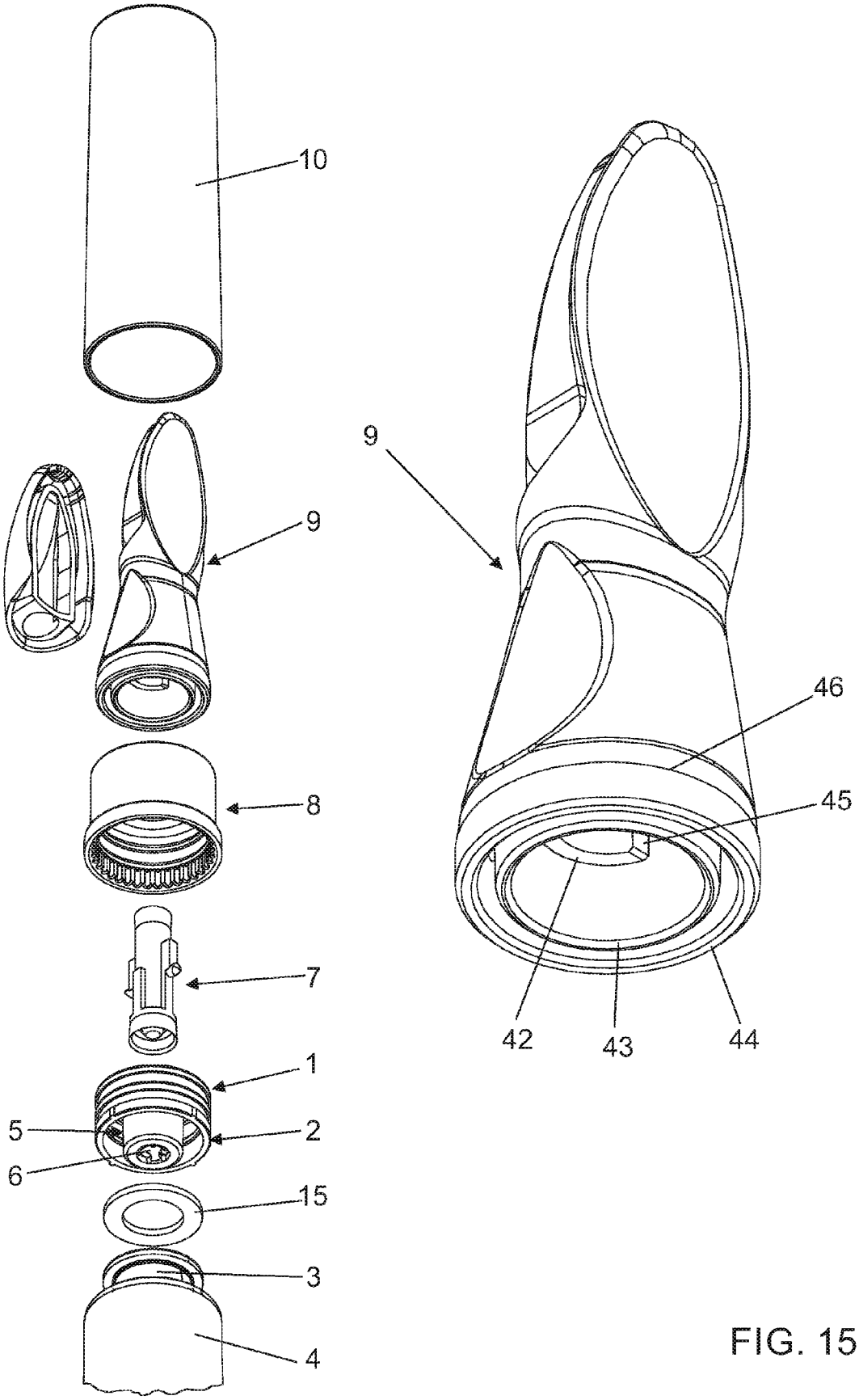

FIGS. 13, 14 and 15 show details of the applicator tip (9), illustrating that its lower end is defined by three concentric walls: an internal wall (42) which defines a feeder tube and coupling; an intermediate wall (43); and an external wall (44). The internal wall (42) is shorter and has two diametrically opposed keyways (45), while the external wall and intermediate walls are the same height, with the lower edge of the external wall being slightly wider, forming a stopper step (46). Between the intermediate (43) and external walls (44) are two twist-control teeth (47). The intermediate (43) and external (44) walls are slid into the respective inner (35) and outer (36) channels of the sleeve (8), resulting in the protruding inner edge (41) of the sleeve (8) and the stopper step (46) of the applicator tip (9) slotting into each other, with the teeth (47) positioned on the rabbet (38) of the outer wall (34), and the follower studs (28) of the vertical plunger (21) coupled to the keyways (45) on the internal wall (42). In this position, the applicator tip (9) cannot move axially, although it is free to slide and twist in both directions, which constitute the opening and closing movements, both movements having a radius of 90° and being limited by the teeth (47) and the vertical pin (40); concomitantly, the vertical plunger (21) is twisted as its follower studs (28) are inserted in the keyways (45) of the applicator tip (9), and consequently the cam (37) moves the first valve (7) upwards or downwards, allowing the inward or outward movement of the internal raised cylindrical stopper (16) in the product passage (6), and thus the opening or closing of the first valve (7).

Figure 16:
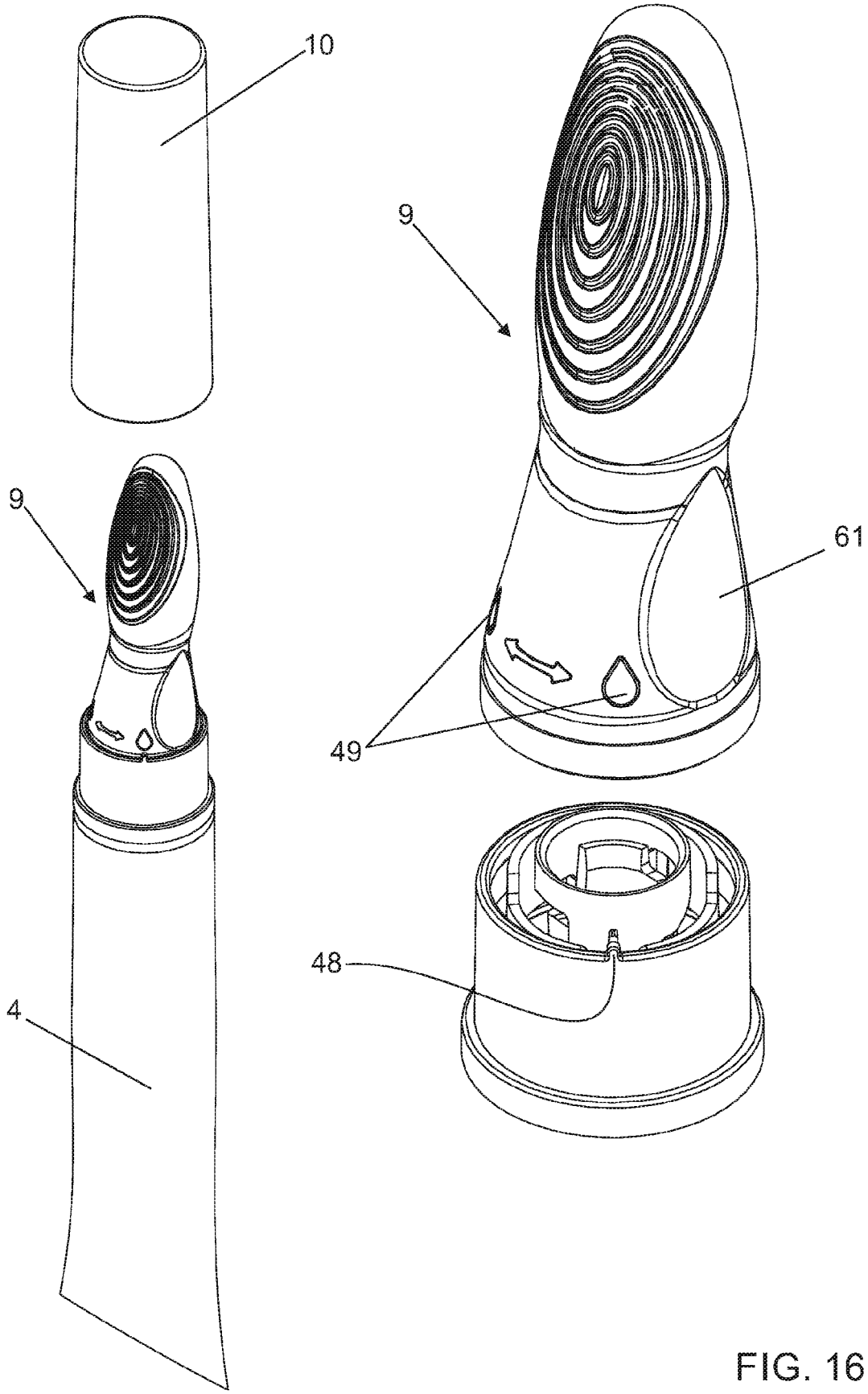
Figure 17:
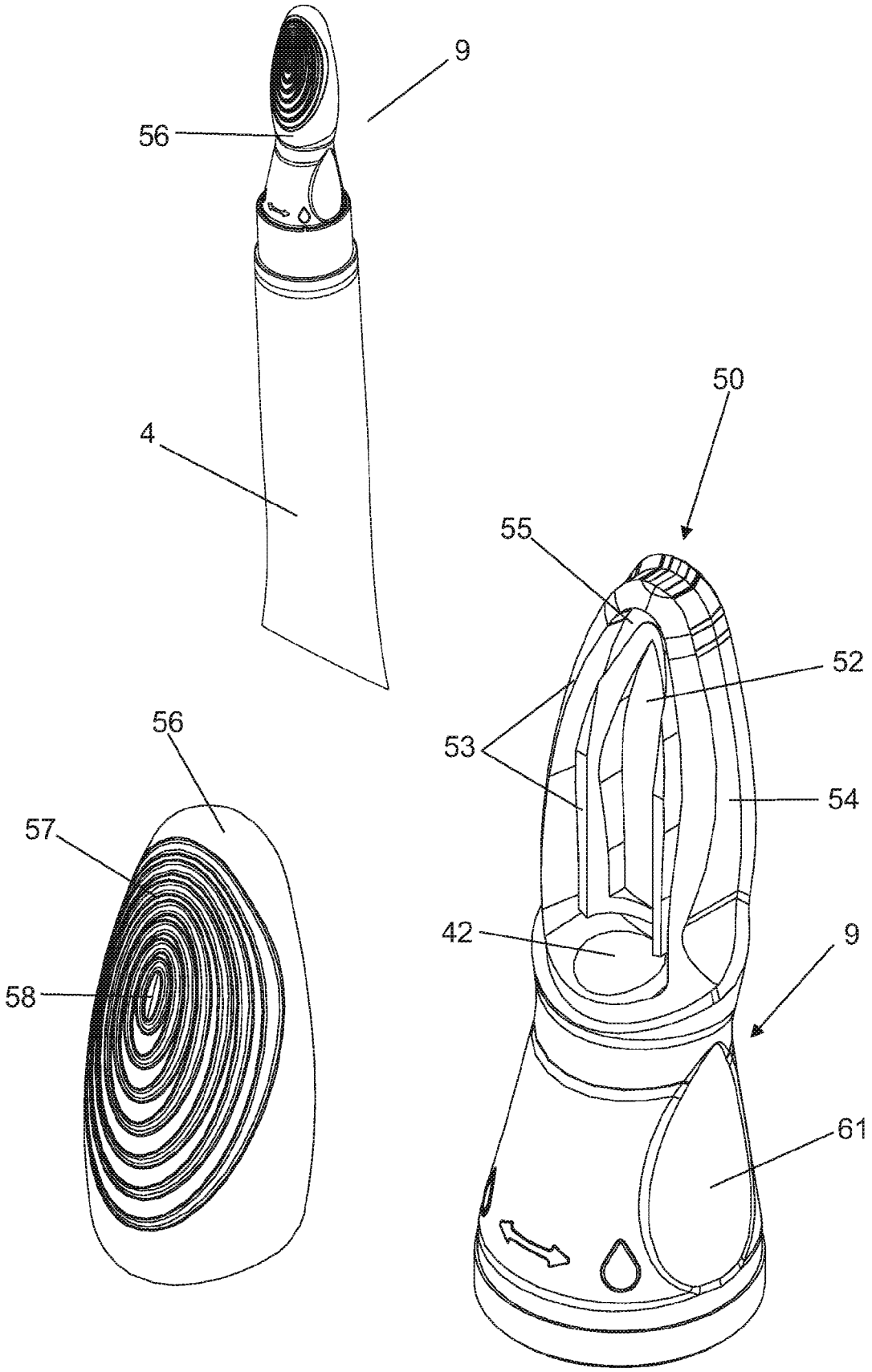
Figure 18:
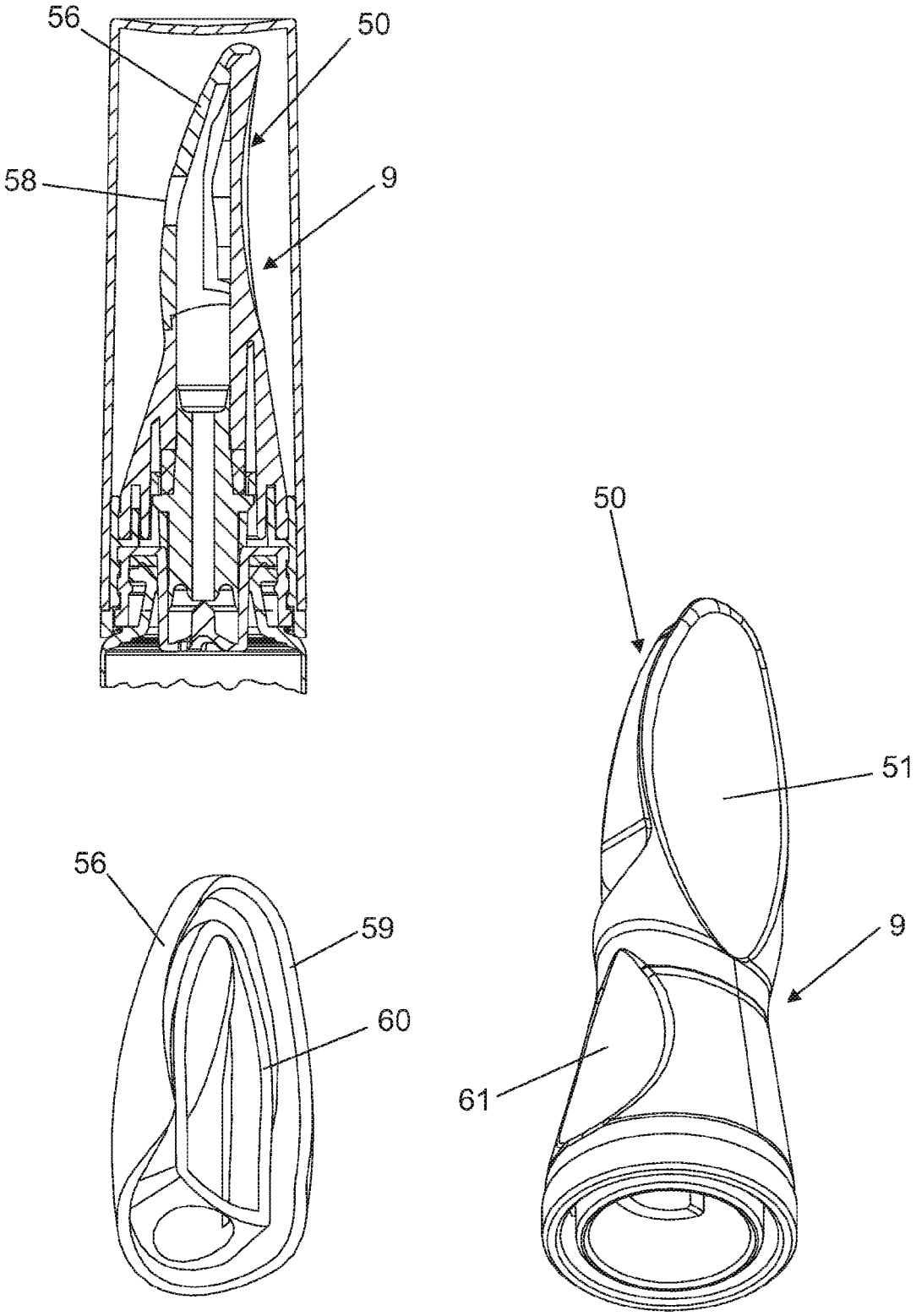

As illustrated in FIG. 16, on the upper edge of the cylindrical skirt (29) of the sleeve (8), a vertical indicator projection (48) faces the outside of the base of the applicator tip (9) and is aligned alternately with the two open and closed indicator buffer marks (49). As illustrated in FIGS. 17 and 18, the upper end of the applicator tip (9) extends in a shape similar to that of the tip of a forefinger, comprising an elliptical tip whose longest axis is positioned vertically, defining a hollow part in the form of a casing (50) that is slightly recessed in the rear wall (51), while its front side forms a small open compartment (52), with the feeder tube defined by the internal wall (42) opening into its lower part and with this open compartment bordered by a double wall (53), forming a recessed border that constitutes an outer casing (54) and defines a housing between the walls (55). This holds the leakproof elastomer cap (56), whose front part is padded and finger-shaped and embossed in a manner defined by a set of concentric elliptical protuberances (57), and having a small central slot valve (58) that releases the product, while on the rear side, the elastomer cap has a similar shape and is defined by an outer wall (59) and an inner wall (60) that are held in position between and on the double wall (53), the outer casing (54) and between the housing (55) of the casing (50). The open compartment (52) of the casing serves as a delivery pouch for the product to be applied, which occurs only when light pressure is created in this inner part by pressing the container (4). Under these conditions, pressure increases against the inner side of the elastomer cap (56), imposing demands on its elasticity, whereby the slot valve (58) is forced open, although only narrowly, so that a desired quantity of the product is released onto the surface concentric elliptical protuberances (57), and when the desired quantity of product is reached, the pressure is no longer applied to the container (4), and the elastomeric memory material of the elastomer cap (56) completely closes the slot valve (58), keeping the applicator tip (9) properly closed, with the remainder of product inside ready for the next operation.

As seen in FIG. 17, the applicator tip (9) includes anatomically shaped recessed lateral grips (61), offering access for the tips of the thumb and forefinger, making it easier to twist the applicator tip (9).

The applicator tip (9) described above features construction details and an anatomical shape that work together to ensure a controlled application of the product on the user's skin, particularly around the eyes, especially products defined generically as cosmetics, although this also includes drug products applied in the same areas, i.e. around the eyes.

Figure 19:
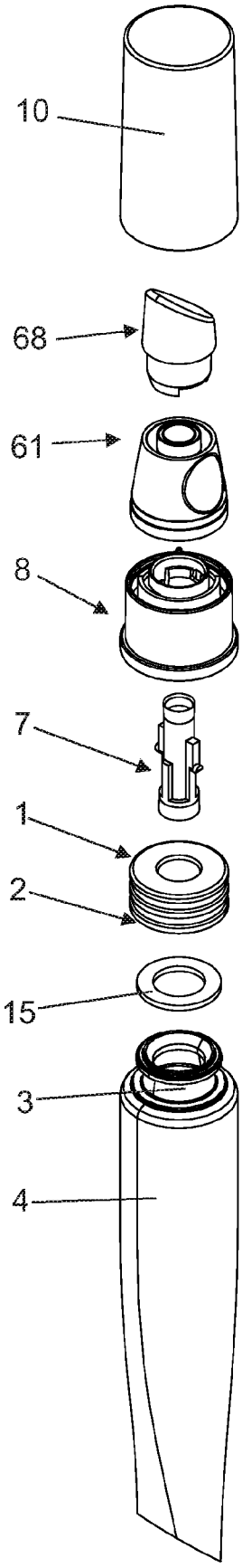
FIGS. 19 to 21 show several views both in perspective and cross-section, illustrating the construction details of a modified applicator tip.
Figure 19:
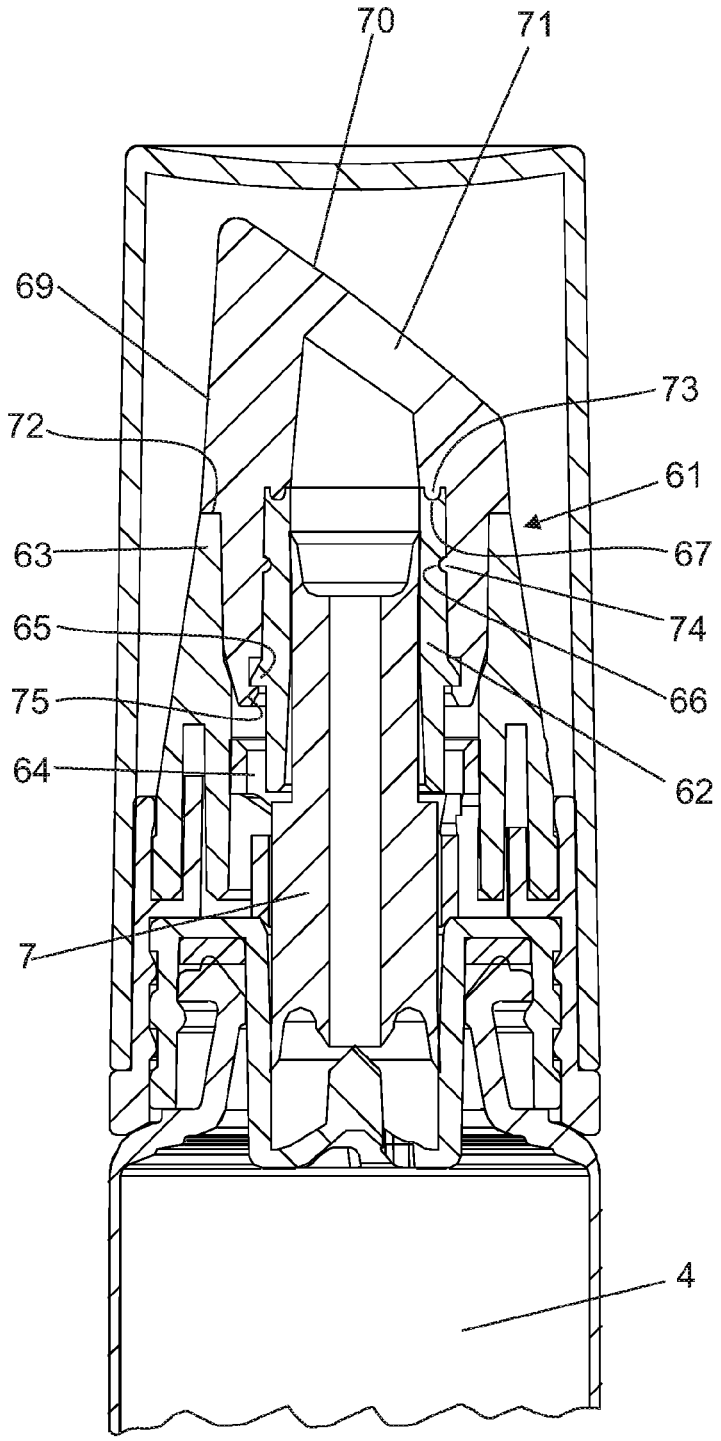

FIG. 19 illustrates another embodiment of the present invention, wherein the assembly is modified to receive an anatomically different applicator tip designed for other parts of the body, particularly those related to the lips, although the shape for this region is more versatile and may also be used in other areas, principally on the face. This modified assembly has almost the same parts as previously described, namely the mounting base (1) which presents the same details for leakproof connection to the bottleneck (3) of a suitable container (4) and with an internal attaching element defining a passage (6) for the product and also constitutes an integral part of the first valve (7). The first valve moves upwards and downwards, and its lower end is oriented to open and close the passage (6), while its end is centrally housed in a sleeve (8) that internally holds the base of the modified applicator tip (61), while the outer part receives the overcap (10) surrounding the modified applicator tip (61). The circular mounting base is coupled to rotate in the in the double sleeve (8), where an actuation mechanism (11) is formed by the two parts, constituting the means for moving the first valve (7) upwards or downwards in order to open and close the product passage (6), in a similar manner to the previously described assembly embodiment.

The modified applicator tip (61) is also axially attached inside the double sleeve (8) whereby it may be twisted in both directions and combines with the actuation mechanism (11) in moving the first valve (7) upwards or downwards in order to open and close the product passage (6).

Figure 20:
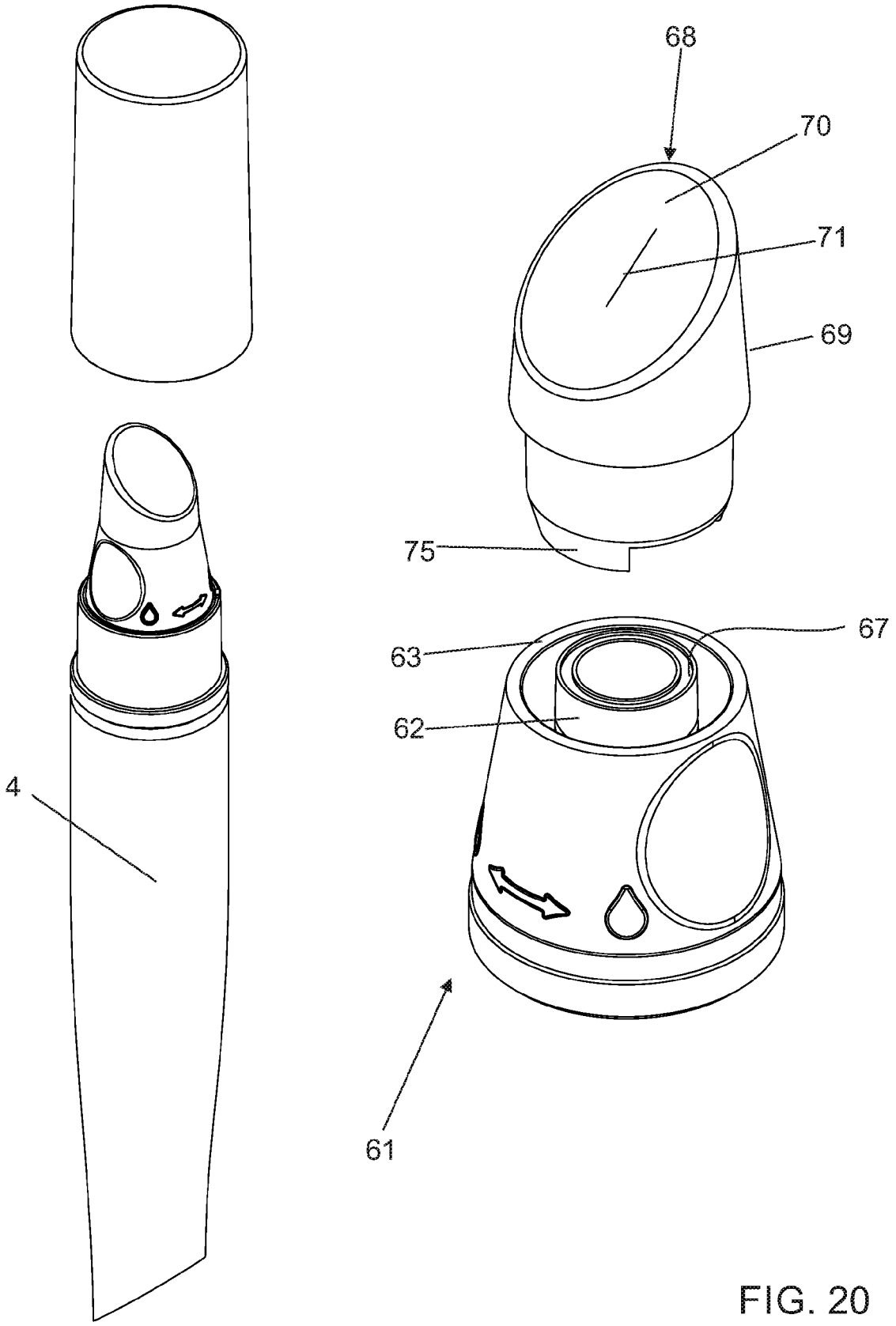
Figure 21:
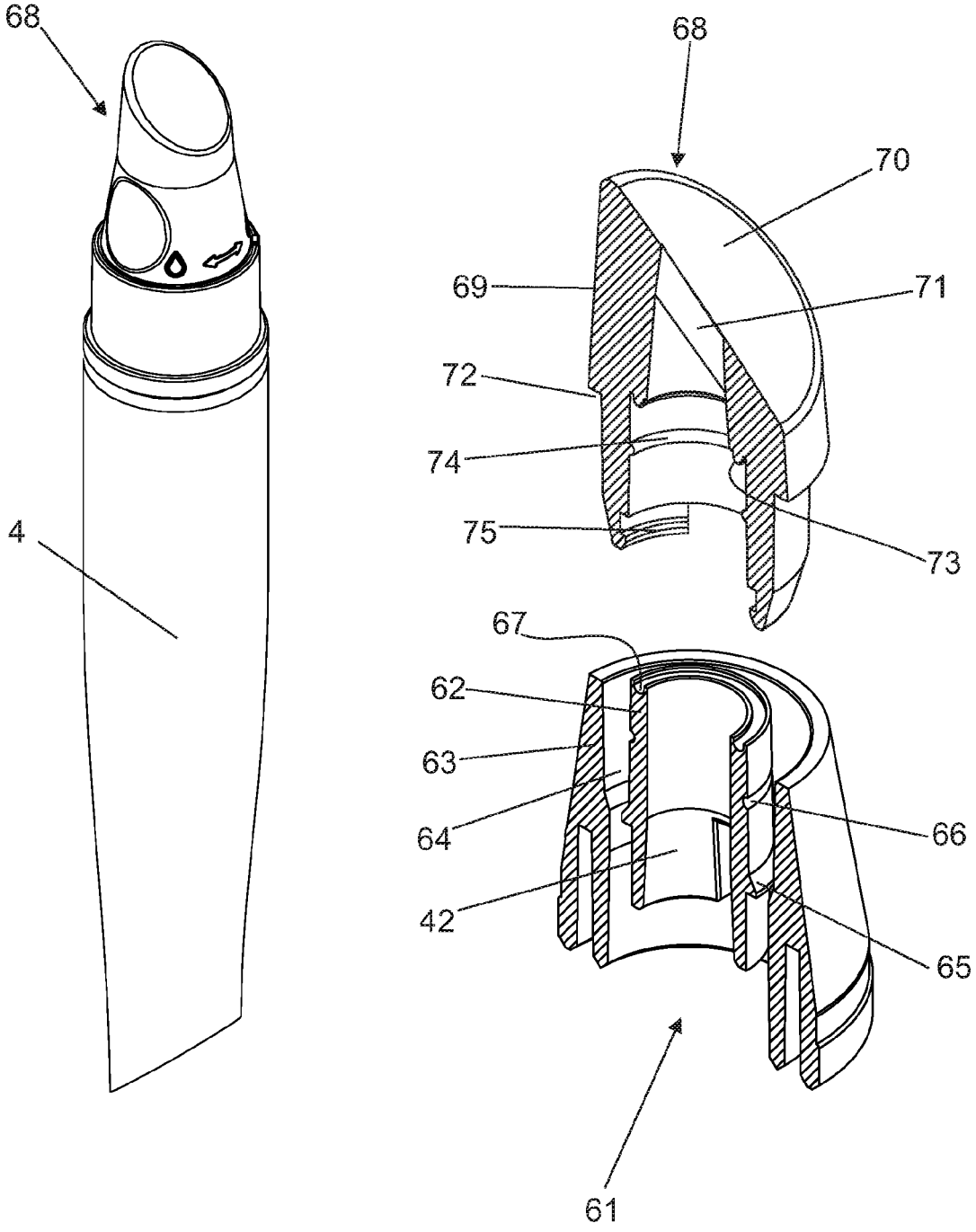

FIGS. 20 and 21 illustrate details of the modified applicator tip, showing that its upper end consists of two prolonged concentric wall sectors, one internal wall sector (62) and one external wall sector (63), with the internal wall sector being an extension of the internal wall defining the feeder tube and coupling (42), whose outer area is defined by a spacing (64) and also has semicircular teeth (65), one on each side, above which is located an annular rabbet (66), and at the top of the internal wall sector is located a top annular channel (67), which constitutes the sealing point. The previous details, the spacing (64), semicircular teeth (65) and annular rabbet (66) form the coupling point for the lower cylindrical part of an elastomer tip (68). The upper end (69) of the elastomer tip is cylindrical and slanted at the top, which constitutes an application surface (70), in which is located a slit valve (71) that releases the product, while the lower part of the elastomer tip is tubular, with a slightly narrower outer diameter that forms an outer step (72). The inner diameter of the elastomer tip is also tubular and forms an inner step, the cross-section of the inner step being shaped like the a top sealing ring (73), below which the inner diameter includes an annular protuberance (74), and finally the lower edge extends in the shape of diametrically opposed hooks (75) that slot into the semicircular teeth (65) when the lower cylindrical part of the elastomer tip (68) is introduced into the spacing (64). Another coupling occurs when the annular protuberance (74) slots into the annular rabbet (66), and at the same time the sealing ring (73) fits into the top annular channel (67).

Similarly to the previously described applicator tip, the pressure against the inner area of the application surface (70) imposes demands on its elasticity, at which time the slit valve (71) is forced open, although only narrowly, and just enough for a desired quantity of the product to be released on the surface (70) and when the desired quantity of product is reached, the pressure is no longer applied to the container (4), with the elastomeric memory material of the elastomer tip (68) completely closing the slit valve (71) and keeping the tip (68) properly closed, with product inside ready for the next operation.

Pursuant to the matters set forth above, it may be noted that the assembly in question materializes the above-mentioned advantages, including functioning of the valve points (7) and (58) or (71), one activated manually and the other functioning automatically, together with the first one.

Figure 22:
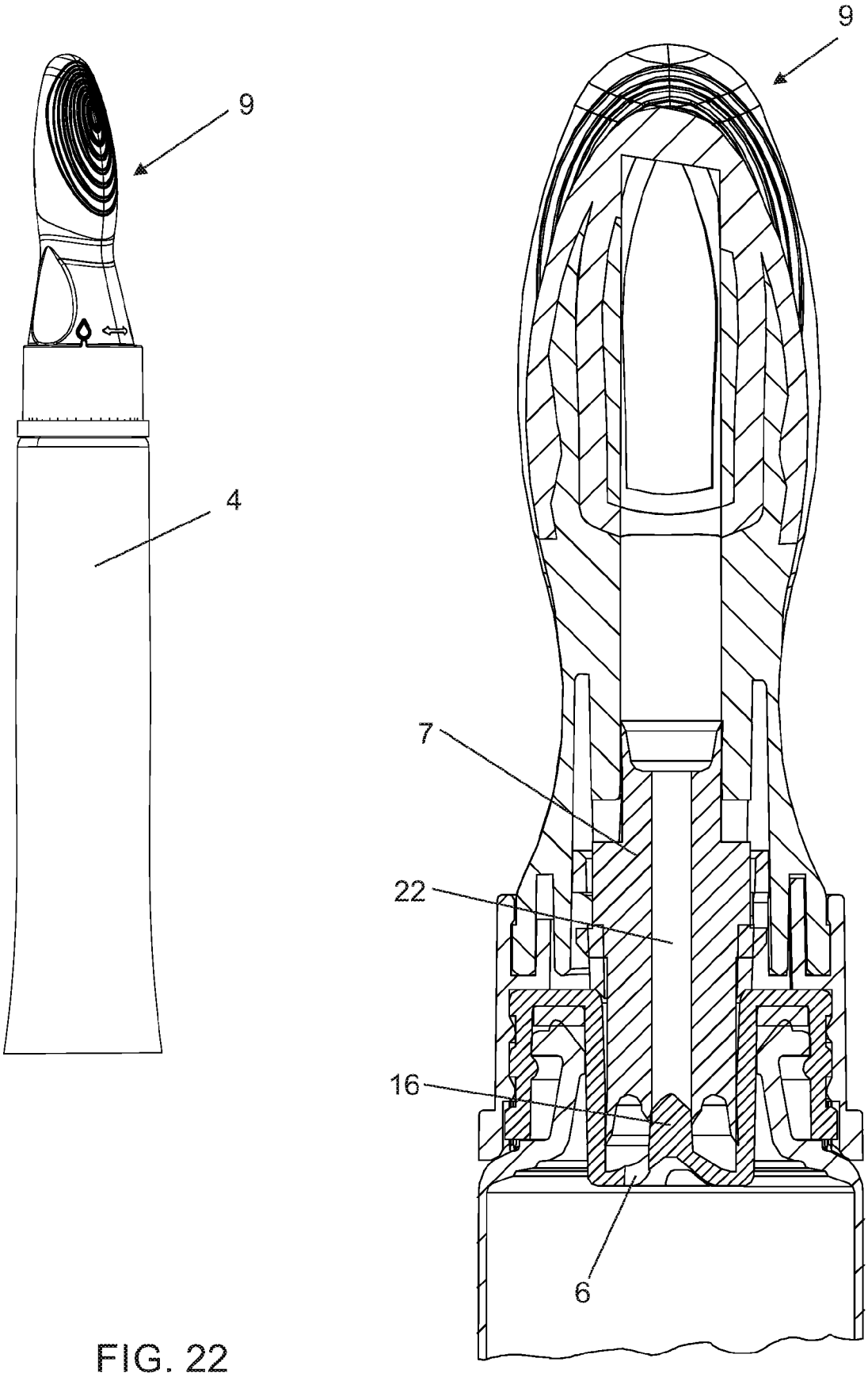
FIGS. 22 and 23 show views illustrating the functioning of the assembly.
Figure 23:
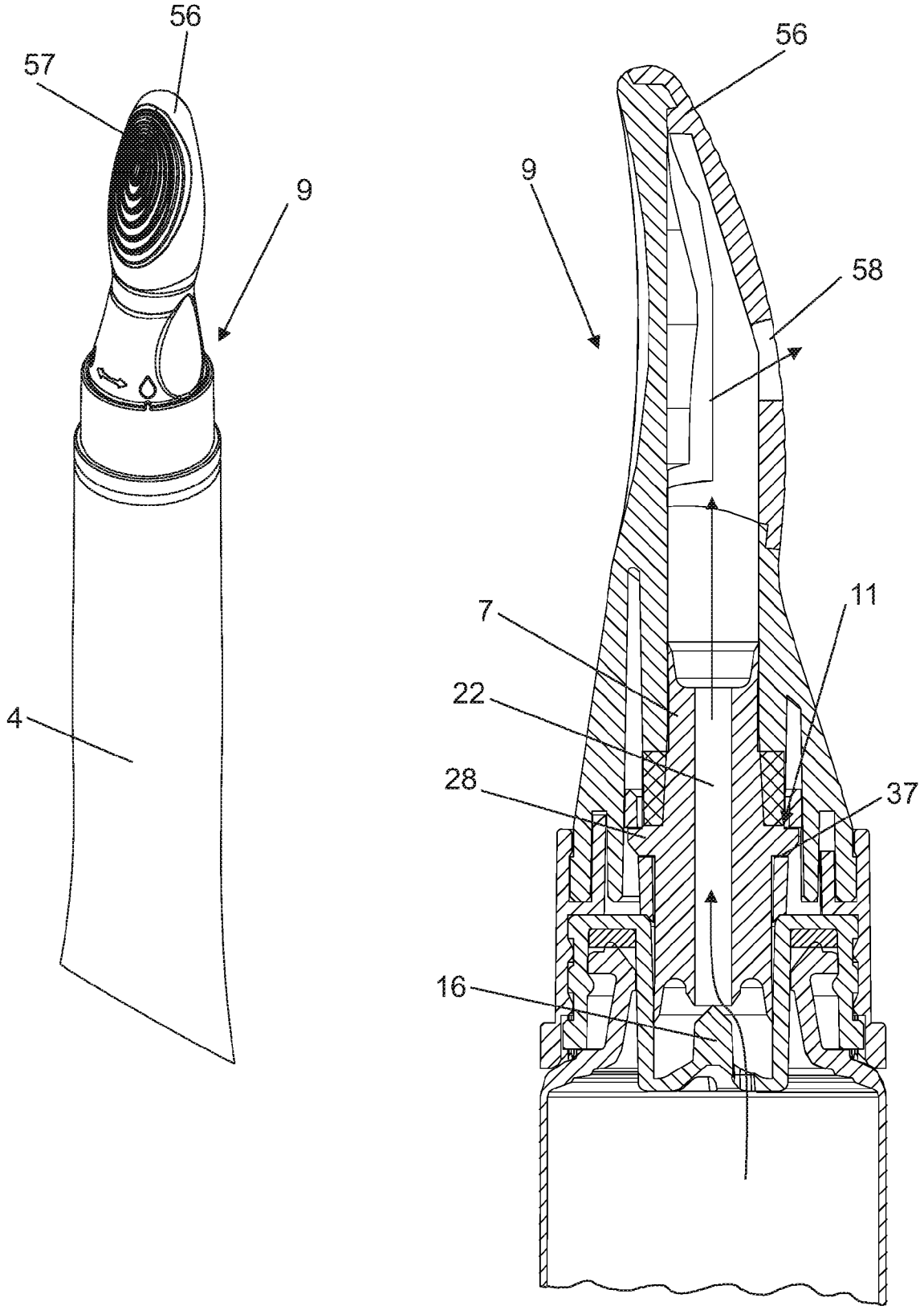

FIG. 22 illustrates the first valve point (7) in the closed position, as defined by the vertical plunger. In this position, the vertical plunger is in its lowest position and consequently the internal raised cylindrical stopper (16) enters into its feeder tube (22) and establishes a leakproof seal that does not allow the product to run from the container (4) to the inside of the of the applicator tip (9). The valve opens only when the applicator tip (9) is twisted. At this time, as illustrated in FIG. 23, the actuation mechanism (11), defined by the two radially opposed follower studs (28) of the vertical plunger, the cam (37) and the rotating base of the applicator tip (9) simultaneously pull the studs (28) to the upper part of the surface of the cam (37), whereby the vertical plunger (7) moves upwards and its lower end models out of the stopper (16), exposing the feeder tube (22); in this position, when the container (4) is pressed, the product flows into the applicator tip (9). At this point, once filled, if pressure is maintained on the container (4), the product begins to press against the inner wall of the elastomer cap (56), forming controlled internal pressure that is sufficient to gradually open the slot valve (58), allowing the controlled flow of the product, that in turn accumulates on the surface concentric elliptical protuberances (57). When the user releases the pressure on the container (4), the product concomitantly ceases to flow into the applicator tip (9), the internal pressure equalizes with the external pressure, and the elastomeric memory material of the elastomer cap (56) allows the slot valve (58) to close again. Once this occurs, the user then twists the applicator tip (9) in the opposite direction, allowing the vertical plunger (7) to return to the closed position.

The product accumulated in the elastomer cap (56) is applied with great comfort, as this section of the cap is soft and padded, like the tip of a forefinger, ensuring extremely easy application of the product to the skin.

The user may thus keep the vertical plunger (7) in the open position while applying the product of the skin, or may leave the vertical plunger (7) in the closed position, after selecting the desired quantity of the product. This allows for excellent control of the applied product.

The invention claimed is:

1. An assembly having a valve mechanism with an applicator tip for cosmetic containers, comprising:

a circular mounting base (1) having an external attaching element (2) for leakproof attachment to a bottleneck (3) of a suitable container (4), and having an internal attaching element (5), wherein the internal attaching element defines a product passage (6) for a product, with the internal attaching element also comprising an integral part of a first valve (7) that slides upwards and downwards, a lower end of the first valve oriented to open and close the product passage (6);

a sleeve (8), centrally housing a terminal end of the first valve, wherein the sleeve also receives internally from above a base of an applicator tip (9), and an outer part of the sleeve receives an overcap (10) surrounding the applicator tip (9), and wherein the mounting base is coupled to rotate inside the sleeve (8);

an actuation mechanism (11) providing a means for moving the first valve (7) upwards and downwards in order to open and close the product passage (6), wherein the actuation mechanism is formed between the mounting base and the sleeve;

wherein the applicator tip is axially attached inside the sleeve (8) and also to a corresponding part of the first valve (7), and the applicator tip is able to freely twist in both directions, causing the actuation mechanism (11) to move the first valve (7) upwards and downwards in order to open or close the product passage (6); and wherein a second slit valve is located in the applicator tip, the second slit valve allowing for control of outflow of the product onto a surface of the applicator tip upon opening and closing of the slit valve.

2. The assembly of claim 1, wherein the mounting base further comprising:

the external attaching element (2) and the internal attaching element (5) of the mounting base (1), formed by a first and a second cylindrical, concentric sectors;

the first sector comprising a circular skirt having an internal lock (12) forming a leakproof attachment to a corresponding lip (13) of the bottleneck (3) of the container (4), and an upper side of the mounting base having a blind flange (14) projecting perpendicularly inwards, the blind flange (14) integrated with the internal attaching element (5) in a cup shape;

wherein the internal attaching element having a diameter fitting tightly into the bottleneck (3) as a stopper, and having a fitted sealing washer (15), and a bottom end of the internal attaching element is pierced to allow throughflow within the product passage (6);

wherein the product passage (6) centrally having an internal raised cylindrical stopper (16) with a tapered tip (17); and wherein the external diameter of the external attaching element (2) having anti-rotational locking lugs (18) and annular channels (19), forming an intermediate axial locking step (20) and allowing for attachment to a bottom end of the sleeve (8).

3. The assembly of claim 1, wherein the first valve further comprising:

a vertical plunger (21) pierced lengthwise by a feeder tube (22), and having an upper end which widens internally, forming an upper sealing lip (23), and a lower end of the feeder tube also widening internally and forming a circular channel (24) which forms two concentric sealing lips, an outer sealing lip (25), and an inner sealing lip (26);

wherein the outer sealing lip slides over the internal attaching element (5) of the mounting base (1), while the inner sealing lip (26) surrounds the end of the feeder tube (22), forming a tip covering the cylindrical stopper (16) that opens and closes the feeder tube (22); and wherein an outer diameter of the vertical plunger (21) is fitted with longitudinal guide lugs (27) and two radially opposed follower studs (28) that couple onto the actuation mechanism (11).

4. The assembly of claim 1, wherein the sleeve further comprising:

a cylindrical skirt (29) having a wider bottom edge forming an external flap (30) defining a slot for a bottom end of the overcap (10) and a lock formed by a protruding inner edge (41) on the cylindrical skirt (29);

the external flap having a plurality of internal grooves (31), two protuberant annular sectors (32) adjacent to an upper section of the grooves, both attached to the mounting base (1), wherein the grooves (31) engage with anti-rotational locking lugs (18) on the mounting base, and the annular sectors (32) engage with annular channels (19) on the mounting base, comprising a coupling and permanent attachment between the mounting base and sleeve components;

wherein an upper part of the sleeve (8) having two additional internal, circular and concentric walls, an inner wall (33) and an outer wall (34), and having an inner channel (35) and an outer channel (36) formed between the inner and outer walls, housing a lower end of the applicator tip (9) in a revolving manner, with the inner wall (33) also comprising a slider housing for an upper end of a vertical plunger that is in the first valve, the vertical plunger also having an upper sealing lip;

wherein the inner wall (33) also includes two diametrically opposed keyways that constitute surfaces of a cam (37), pierced by two radially opposed follower studs (28) located upon the first valve and exposed in the inner channel (35), the studs in a position to couple with a lower end of the applicator tip (9); and wherein the upper edge of the inner wall (33) of the sleeve (8) is lowered over a rabbet (38) ending in rabbet buffers and a light lock (39) defining an open and a closed position of the first valve, the rabbet (38) also having a vertical pin (40) as a midline projection, constituting a buffer and limit on a 90° movement of the overcap, allowing the applicator tip to move the follower studs over the surfaces of the cam to move the first valve upwards or downwards.

5. The assembly of claim 4, wherein the applicator tip further comprising:

a base of the applicator tip (9), having three concentric walls, an internal wall defining a feeder tube and coupling (42), an intermediate wall (43) and an external wall (44), wherein the internal wall is shorter and having two diametrically opposed keyways (45), and the external wall and intermediate walls having the same height, with a lower edge of the external wall being slightly wider, forming a stopper step (46), and wherein between the intermediate wall (43) and the external wall (44) are two twist-control teeth (47);

wherein the intermediate wall (43) and external walls (44) slide into the corresponding inner channel (35) and the outer channel (36) of the sleeve (8), allowing the protruding inner edge (41) of the sleeve (8) and a stopper step (46) of the applicator tip (9) to slot into each other, with teeth (47) positioned on the rabbet (38) of the outer wall (34), and two radially-opposed follower studs (28) located on a vertical plunger (21) of the first valve being coupled to the keyways (45) on the internal wall (42), allowing the applicator tip to twist 90° in both directions, constituting the opening and closing movements, and preventing the applicator tip moving axially.

6. The assembly of claim 4, wherein the sleeve further comprising:

the cylindrical skirt (29) having a vertical indicator projection (48) on an upper edge, facing outwardly on a base of the applicator tip (9) and aligned alternately with two open and closed indicator buffer marks (49).

7. The assembly of claim 5, wherein the applicator tip further comprising:

an upper end of the applicator tip (9) extending in an anatomical shape of the tip of a forefinger;

the upper end comprising an elliptical tip wherein a longest axis is positioned vertically, the anatomical shape defining a hollow casing (50) slightly recessed in a rear wall (51), and having an open compartment (52) formed on a front side, with the feeder tube opening into a lower part of the open compartment, and the compartment bordered by a double wall (53), forming a recessed border constituting an outer casing (54) and defining a housing (55) between the walls;

wherein the housing holding a leakproof elastomer cap (56), a front part of the elastomer cap having a finger-shape and padding, wherein the front part also having a set of concentric elliptical protuberances (57) embossed upon a surface and a small slot valve (58) in the center of the surface that releases the product; and wherein the elastomer cap having on a rear side an outer wall (59) and an inner wall (60), and the elastomer cap is held in position upon the double wall (53) and the outer casing (54), and in between the housing (55) of the outer casing (50); and wherein the open compartment (52) serves as a delivery pouch for the product to be applied, the delivery occurring upon light pressure on the container, that increases pressure against an inner side of the elastomer cap (56), forcing the slot valve (58) open and releasing product onto the elliptical protuberances (57) on the surface of the elastomer cap.

8. The assembly of claim 1, wherein the applicator tip further comprising anatomically shaped recessed lateral grips (61), offering access for tips of a thumb and a forefinger.

9. The assembly of claim 1, wherein the applicator tip is a modified applicator tip (61) comprising:

an upper end formed by two prolonged concentric wall sectors, an internal wall sector (62) and an external wall sector (63), the internal wall sector being an extension of an internal wall defining a feeder tube (42), having an outer diameter defined by a spacing (64), and having two semicircular teeth (65), one located on each side, and having above the teeth an annular rabbet (66), and atop the internal wall sector having a top annular channel (67), defining a sealing point;

a coupling point for a lower cylindrical part of an elastomer tip, formed by the spacing (64), the semicircular teeth (65) and the annular rabbet (66), wherein an upper end (69) of the elastomer tip is cylindrical and slanted at a top section, constituting an application surface (70), upon which is located a slit valve (71) for release of the product, and wherein a lower part of the elastomer tip is tubular, having a slightly narrower outer diameter forming an outer step (72), and an inner diameter that is also tubular forming an inner step, a cross-section of the inner step being shaped as a top sealing ring (73); and wherein below the sealing ring the inner diameter includes an annular protuberance (74), and a lower edge extends in a shape of diametrically opposed hooks (75) which slot into the semicircular teeth (65) when a lower cylindrical part of the elastomer tip (68) is introduced into the spacing (64), with another coupling occurring when the annular protuberance (74) slots into the annular rabbet (66), and at the same time the sealing ring (73) fits into the top annular channel (67).

* * * * *